US011319719B2

(12) United States Patent
Van Aukee et al.

(10) Patent No.: US 11,319,719 B2
(45) Date of Patent: May 3, 2022

(54) MODULAR SPACE DIVIDING SYSTEM AND METHOD

(71) Applicants: Eric Van Aukee, Los Angeles, CA (US); Yan Krymsky, Venice, CA (US); Ryan D. Hollien, Los Angeles, CA (US); Mohsen Ghanbari, Los Angeles, CA (US)

(72) Inventors: Eric Van Aukee, Los Angeles, CA (US); Yan Krymsky, Venice, CA (US); Ryan D. Hollien, Los Angeles, CA (US); Mohsen Ghanbari, Los Angeles, CA (US)

(73) Assignee: PERKINS + WILL, INC., Chicago, IL (US)

( * ) Notice: Subject to any disclaimer, the term of this patent is extended or adjusted under 35 U.S.C. 154(b) by 0 days.

(21) Appl. No.: 16/579,553

(22) Filed: Sep. 23, 2019

(65) Prior Publication Data

US 2020/0095787 A1 Mar. 26, 2020

Related U.S. Application Data

(60) Provisional application No. 62/734,923, filed on Sep. 21, 2018.

(51) Int. Cl.

| | |
|---|---|
| ***E04H 1/12*** | (2006.01) |
| ***E04B 1/343*** | (2006.01) |
| ***E04B 1/348*** | (2006.01) |

(52) U.S. Cl.

CPC ..... *E04H 1/125* (2013.01); *E04B 1/34347* (2013.01); *E04B 1/34861* (2013.01)

(58) Field of Classification Search

CPC ..... E04H 1/125; E04B 1/34861; A47B 83/00

See application file for complete search history.

(56) References Cited

U.S. PATENT DOCUMENTS

| | | | | | |
|---|---|---|---|---|---|
| 3,498,011 | A * | 3/1970 | Lindgren | E04H 1/125 | 52/31 |
| 3,808,607 | A * | 5/1974 | Harder | A47K 4/00 | 4/545 |
| 4,109,328 | A * | 8/1978 | Mason | A47B 83/00 | 312/111 |
| 4,237,563 | A * | 12/1980 | Ollerman | A47B 83/00 | 5/2.1 |
| 4,594,817 | A * | 6/1986 | McLaren | A47C 19/20 | 52/34 |

(Continued)

FOREIGN PATENT DOCUMENTS

| | | | |
|---|---|---|---|
| DE | 3603055 | A1 * | 1/1986 |
| DE | 19832492 | A1 * | 7/1998 |

(Continued)

*Primary Examiner* — Adriana Figueroa
(74) *Attorney, Agent, or Firm* — Buchalter

(57) ABSTRACT

A modular system for creating a temporary plurality of individual living spaces, may include a plurality of anchors, where pairs of anchors create opposing sides of a personal space. A frame may be positioned between the pairs of anchors to create a bedding structure. The anchors may also provide storage space, lights, power source, among other features of a living area. A covering may be used between the pairs of anchors to separate the living space from the rest of the space to improve individual privacy.

19 Claims, 14 Drawing Sheets

(56) References Cited

U.S. PATENT DOCUMENTS

| | | | | | |
|---|---|---|---|---|---|
| 5,713,650 | A * | 2/1998 | King | A47B 81/00 | 312/265.4 |
| 6,167,579 | B1 * | 1/2001 | Kopish | A47B 57/40 | 5/2.1 |
| 8,418,282 | B2 * | 4/2013 | Luft-Weissberg | A47C 17/52 | 5/2.1 |
| 2012/0266544 | A1 * | 10/2012 | Lazarovits | A47B 83/00 | 52/79.1 |
| 2016/0038363 | A1 * | 2/2016 | Sharitz | E04H 1/125 | 600/21 |
| 2018/0363311 | A1 * | 12/2018 | Liao | E04H 1/02 | |

FOREIGN PATENT DOCUMENTS

| | | | | |
|---|---|---|---|---|
| FR | 2637793 | A1 * | 4/1990 | G01N 33/0001 |
| WO | WO-9410402 | A2 * | 5/1994 | E04B 1/8218 |
| WO | WO-0233199 | A1 * | 4/2002 | E04H 1/125 |
| WO | WO-2019045635 | A1 * | 8/2017 | |

* cited by examiner

MODULAR SPACE DIVIDING SYSTEM AND METHOD

PRIORITY

This application claim priority to U.S. Provisional Patent Application No. 62/734,923, filed Sep. 21, 2018, which is incorporated by reference in its entirety herein.

BACKGROUND

Modular and temporary sleeping and living spaces are needed within homeless shelters, disaster relief areas, temporary event spaces, and other conditions where you have a large congregation of people that need to be housed in the same space.

People in these crowded conditions are often housed within a single building envelope. Historically, individual spaces have been cordoned off by using cots, sleeping mats, movable rods and curtains, dividers, etc. But living space created by these temporary constructs are not conventionally reproducible, not efficiently dynamic in that they do not provide for sturdy and reproducible set up/tear down in any convenient or time efficient manner, not modular, and not efficient to store. These sleeping/living spaces are currently only made from piecemeal components that are not space efficient in a deployed or a stored condition, not easily or efficiently reproducible, not easily constructed and/or deconstructed, not sturdy, and not private.

SUMMARY

Exemplary embodiments of the Modular Space Dividing System described herein includes a modular, unitized system. Exemplary embodiments may be used for interim and emergency housing. Exemplary embodiments of the Modular Space Dividing System may collapse to a reduced volume footprint for efficient storage and shipping, bringing initial installation costs down and giving operators flexibility to surge and flex in response to immediate/seasonal need. Exemplary embodiment reduce connection materials, such as loose elements to facilitate easy storage, building, transportation, and retention while reducing the likelihood of essentially elements becoming lost or unusable.

DETAILED DESCRIPTION

In the following description of preferred embodiments, reference is made to the accompanying drawings which form a part hereof, and in which it is shown by way of illustration specific embodiments in which the invention can be practiced. It is to be understood that other embodiments can be used and structural changes can be made without departing from the scope of the embodiments of this invention.

Exemplary embodiments of the Modular Space Dividing System described herein include a modular, unitized system. Exemplary embodiments may be used for interim and emergency housing. It may include all the essential furnishings commonly found in interim housing providing a private place to sleep and lockable storage. Exemplary embodiments of the Modular Space Dividing System may collapse to a tiny footprint (approximately 30"×84") for efficient storage and shipping, bringing initial installation costs down and giving operators flexibility to surge and flex in response to immediate/seasonal need. All components may be contained within a single unit without loose elements that can get lost in storage.

Exemplary embodiments described herein include a modular system made of individual construction units for creating personalized space within an interior structure. The individual construction units are configured for easy and efficient transition between a collapsed configuration and a deployed configuration. The collapsed configuration is configured such that a plurality of construction units may be easily, efficiently, and compactly stored within a given area. The deployed configuration is configured such that a plurality of construction units may be positioned relative to each other to define individual personalized spaces.

As described herein the individual personalized space may include a bedding, changing, and/or storage area. However, the invention is not so limited. Exemplary embodiments may be used for other temporary compartmentalized space, such as desk or office space, changing rooms, storage space, etc. For example, the height of the structure and frame of the bedding support may be raised to create a frame for a desk surface. Alternatively, the width of the bed frame may be reduced to transform a bed support into a bench or other seating support such as may be used in a dressing room.

Figure 1:
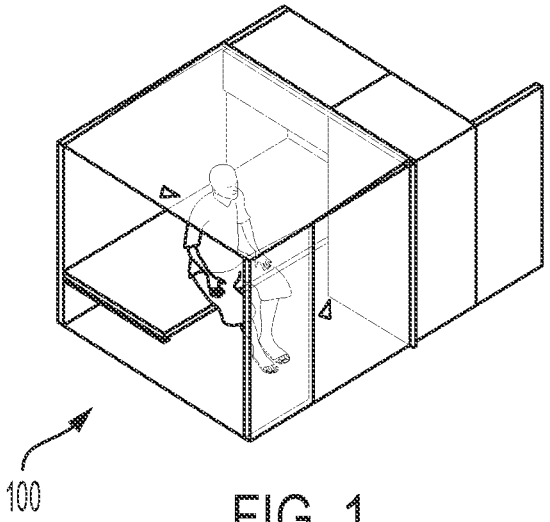
FIG. 1 illustrates an exemplary modular system in a deployed configuration according to embodiments described herein.

FIG. 1 illustrates an exemplary modular system in a deployed configuration according to embodiments described herein. As shown, the modular system 100 is made of construction units that can be combined together to define repeatable and/or different configurations. As shown, a modular unit may be positioned sequentially in line to create recurring and neighboring enclosures and/or semi-enclosures. As shown, enclosures may include different combination of features such as walls, doors, ceiling, ledge, storage space, and any combination thereof. The ledge may be configured as a bed support, a seat such as a bench, a shelf, desktop, or a ledge for any such purpose. The storage space may be any combination of space, such as shelves, drawers, cabinets, opening, etc.

Figure 2:
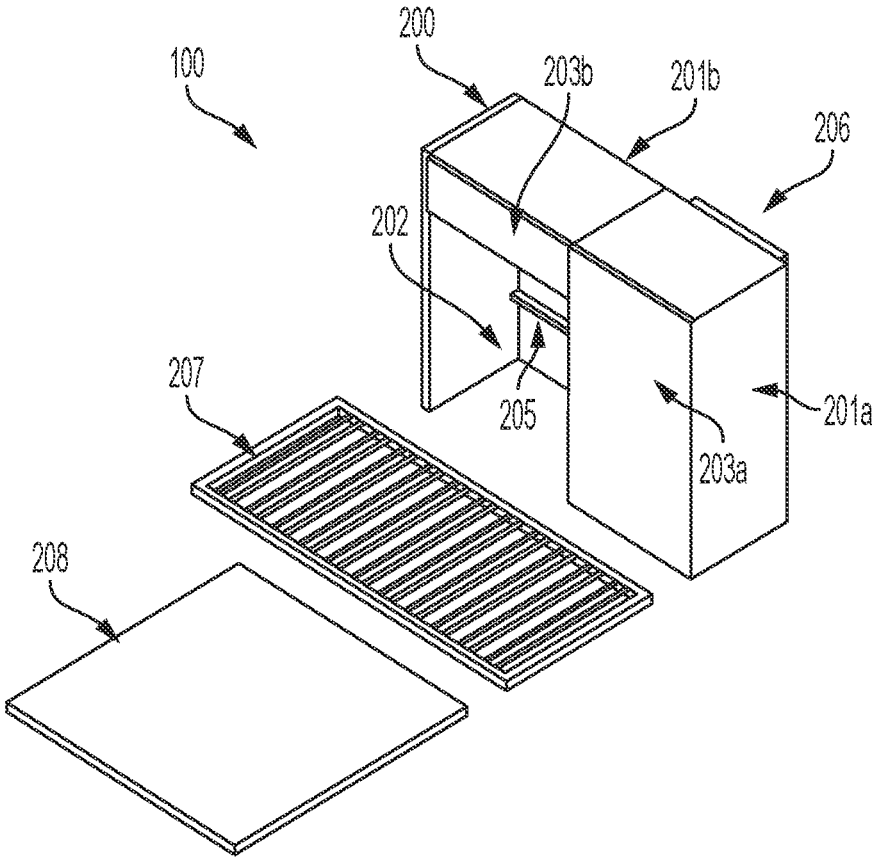
FIG. 2 illustrates an exemplary modular system in a construction configuration according to embodiments described herein.

FIG. 2 illustrates an exemplary modular system in a construction configuration according to embodiments described herein. As shown, the construction unit 100 may include an anchor 200, bed frame 207, and wall 208. The bed frame 207 may be any ledge configuration as described herein. The anchor may include storage space 203*a*, 203*b* as described herein.

According to embodiments of the invention, the anchor 200 may be configured to support the rest of the construction unit and/or modular system. Therefore, the anchor may be configured with a first dimension 201*a* and a second dimension 201*b*. The first and second dimensions may be configured to provide a support to the anchor in a standing position. Therefore, the first and second dimensions may be out of plane of each other to create a support structure or stand for other components of the modular system. As shown, the first and second dimension of the anchor is not collapsible. However, exemplary embodiments may include a collapsible anchor.

The anchor 200 may define a support structure for the construction unit. In an exemplary embodiment, the space created within the first and second dimension may be used fully or partially for storage space 203*a*, 203*b*. The storage space may be any combination of cabinets, shelves, drawers, other space organizer, and combinations thereof. As shown, the storage space includes an enlarged cabinet and as described herein. Exemplary embodiments may be used and deployed in a first orientation and stored in a second orientation rotated relative to the first orientation. Therefore, exemplary embodiments may configure the storage space such that rotation, translation, or other repositioning of the storage space maintains the storage space in its shape and configuration. For example, conventional shelves are defined by planar boards positioned on projections or prongs on an interior surface of a vertical support, and the shelf maintained in place under the influence of gravity against the projections. If such a shelf system were reoriented such that gravity is acting in a different direction relative to shelf so that gravity no longer applies a force on the shelf against the projections, the shelf is likely to reposition within the storage space. Therefore, exemplary embodiments described herein may include connections between component parts and/or within the storage space to rigidly maintain a design of the storage space regardless of the orientation, or transition of the orientation of the storage space.

The anchor 200 may include a cavity 202 against wall defining dimension 201*b*. The cavity 202 may include support structures 205 for other component parts. The support structure may be a projection or ledge for supporting another frame, such as bed frame 207. The cavity 202 may include more than one support structure. The plurality of support structures may be used to selectively position the frame. For example, a first support structure may be at a first height convenient for a bed height. A second support structure may be at a second height convenient for sitting. A third support structure may be at a third height convenient for a desktop. A plurality of support structures may also be provided to support smaller frames, such as for shelving, or other purpose.

The anchor 200 may also support and have coupled thereto a wall portion 206. The wall portion 206 may be coupled to the anchor 200 with a rotational coupling, such as a hinge. The rotational coupling may permit the anchor and wall to be configured in a deployed configuration and a collapsed configuration. The collapsed configuration may position the wall adjacent and approximately parallel to the back surface of the anchor.

Figure 3:
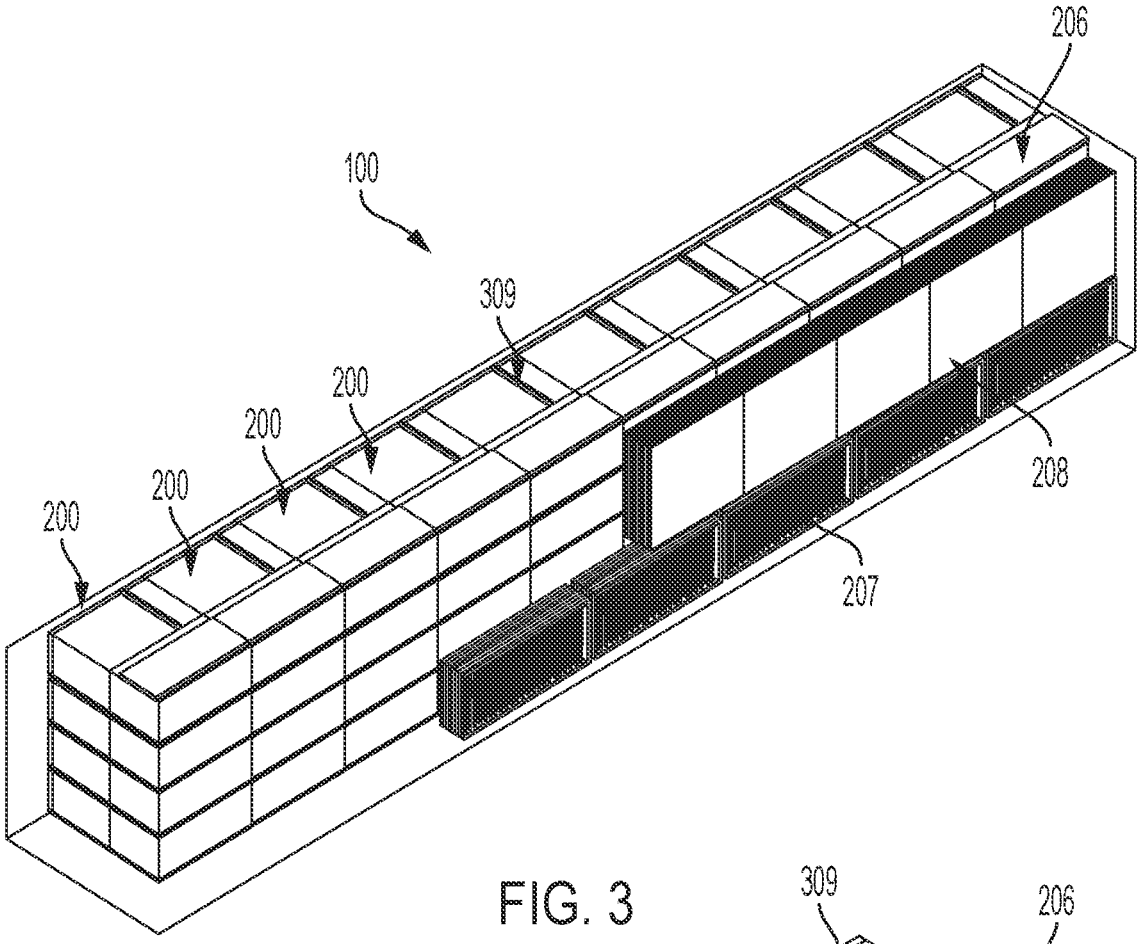
FIG. 3 illustrates an exemplary modular system in a stored configuration according to embodiments described herein.

The modular system 100 may include a frame 207. The frame may be any support frame for attachment between anchors of adjacent construction units. The frame may be a solid rectangular, planar construction. The frame may include a rectangular perimeter and include a plurality of extensions extending across the frame. The gaps in the frame may be to reduce weight. The frame may be supported between anchors by positioning the frame on the support structure. As seen in FIG. 3, the opposing side of the anchor from the side defining the cavity 202, may also include a support structure 309. The frame 207 may extend between and be support by support structures on adjacent anchors.

The modular system 100 may include a wall 208. The wall 208 may be configured to be positioned between two anchors of adjacent construction units. The anchor and wall may be removably coupled together. The wall portion may include a support structure for positioning along or under the frame 207. The wall portion may include mated structures for attaching to the anchor and/or the frame to couple the frame, wall, and anchor(s) together. For example, the wall portion may include L shaped projections to provide an outward projection from the face of the wall for supporting the frame and an upward extension from the end of the outward projection for holding the wall upright, thereby securing the frame between the wall and the upward extension.

Exemplary component parts may be coupled together through various fastening mechanisms. Exemplary fastening mechanisms include hinge, hook, support structure, mated surfaces, as described herein. Other fastening mechanisms may include screws, bolts, rivets, rods, dowels, indents/detents, nails, hook and loop, among other fastening mechanisms. Exemplary embodiments use limited or no separate fasteners from the component parts for which they couple. By removing separable fasteners, the components may be frequently deconstructed and reconstructed without loss of parts. Exemplary fasteners may include slotted mated structures.

FIG. 3 illustrates an exemplary modular system in a stored configuration according to embodiments described herein. As shown, an outer surface profile of the anchor in a collapsed configuration defines a rectangular cube. The outer surface profile is defined by an imaginary plane through the terminal portion of the outermost projections or surfaces on each of the sides of the anchor. As shown, opposing sides of the collapsed configuration of the anchor defines parallel planar surfaces for easy and convenient stacking. As shown, the support structure 309 projects from the anchor 200 surface and approximate distance equivalent to the thickness of the wall 206. The approximation in thickness to between the projection dimension and the wall thickness may include any manufacturing tolerances as well as offset distances created by fastening parts, such as the hinge between the wall and anchor. The approximation, however, should be sufficient precise so that multiple units can be stacked without the units sliding off of each other.

Figure 4:
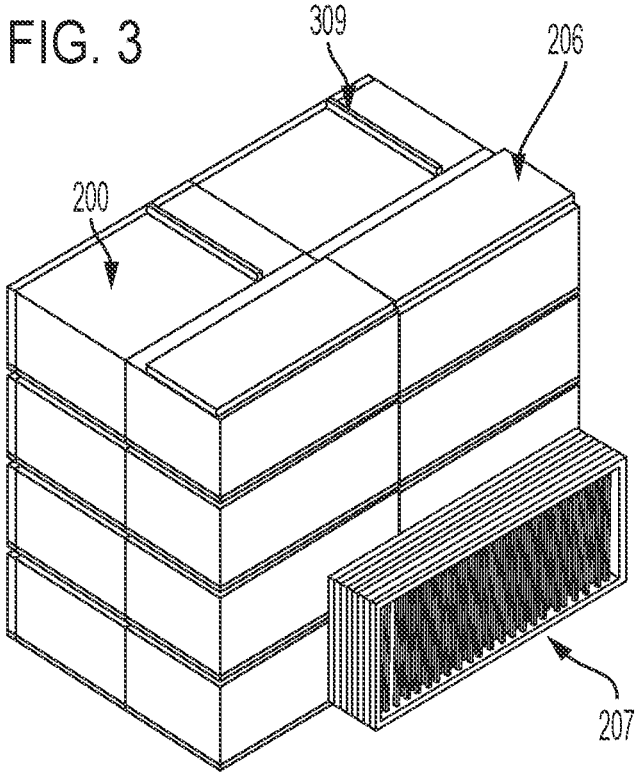
FIG. 4 illustrates an exemplary modular system in a stored configuration according to embodiments described herein.

FIG. 4 illustrates an exemplary modular system in a stored configuration according to embodiments described herein. As shown, various configurations of storage arrangements are possible with a plurality of anchors 200 positioned together in a collapsed configuration and other components such as wall 208 and frame 207, similarly grouped and stacked together.

Figure 5:
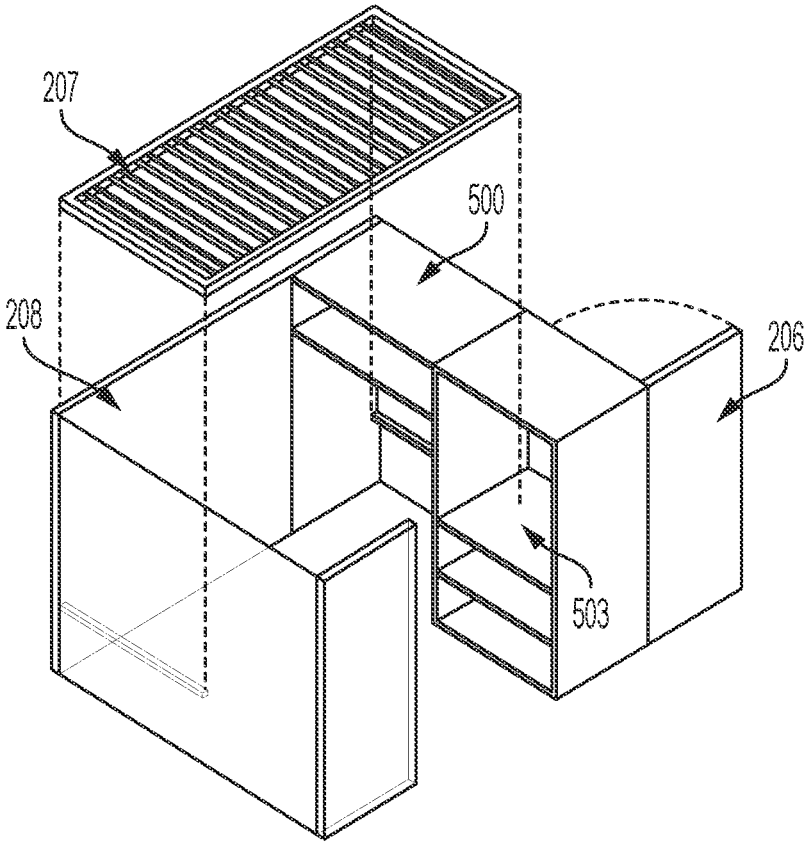
FIG. 5 illustrates an exemplary modular system in a separated component part view according to embodiments described herein.

FIG. 5 illustrates an exemplary modular system in a separated component part view according to embodiments described herein. As shown, different component parts, such as wall 206 and anchor 500 may be directly, permanently, rotatably coupled together. Other component parts may be separated and attached, such as wall 208, frame 207, and anchor 500. The frame 207 may be supported between support structures on opposing sides of adjacent anchors. FIG. 5 illustrates exemplary storage space 503 including shelves. The shelves may be enclosed by cabinet doors or may be open.

Figure 6:
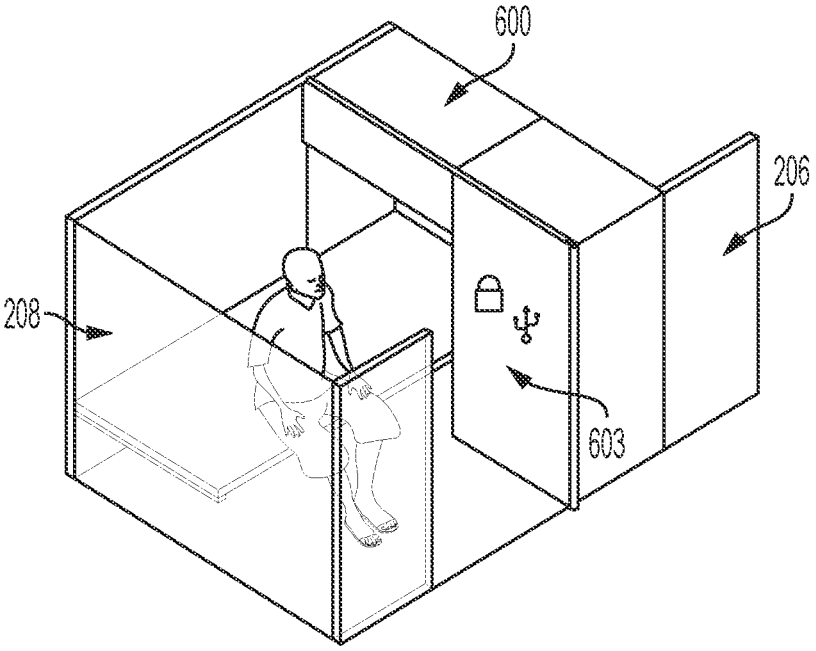
FIG. 6 illustrates an exemplary modular system in a deployed configuration according to embodiments described herein.

FIG. 6 illustrates an exemplary modular system in a deployed configuration according to embodiments described herein. As shown, a personal space may be defined by an enclosure created between a first side of a first anchor, a wall, and a second side of a second anchor. The anchors may be the same configuration and shape or may be different as described herein. The first side of the anchor may include the storage space and/or cavity as described herein, and the second side of the anchor may be on a side opposite of the anchor than the first side. The second side may be planar and may have a support structure extending from the planar surface. A frame may extend between and be supported by support structures of adjacent anchors. FIG. 6 illustrates doors 603 enclosing shelves of the storage space.

Exemplary embodiments of the modular system according to embodiments described herein may include additional features. For example, the anchor 600 may include power connections, such as charging ports for coupling a phone. The anchor 600 may include lights such as in cavity. The anchor 600 may include exterior lights, such as along a bottom of the anchor for aisle lighting. In a deployed configuration, a plurality of anchors may be arranged such that hallways are defined between and along personal spaces. Lower portions of exterior sides of the anchor outside of the defined personal space may include lighting for persons traversing the hallways in low lit times, such as in the evening and night. Exemplary embodiments may include methods and structures for passing electricity between anchors. For example, anchor 600 may include internal wiring to support power to lights, charging portions, etc. Wiring may be coupled to external connections such as AC ports, wiring ports, or connection ports. Connection ports may be integrated into other component parts of the system, such as, for example, wall 208 or ceiling (not shown) such that when the component parts of the modular system are coupled together by the connection port, an electrical connection is made across component parts to pass electricity through to adjacent anchors. Thus, adjacent construction units may be electrically coupled together.

Exemplary embodiments of the storage space may include lockable cabinets. The cabinets may include a lock integrated into the cabinet door. The cabinet may include mated loops to support a lock of an individual such as a pad lock and retain the storage cavity in a locked configuration. The storage space may be configured to be locked and stored such that an individual may safeguard belongings when the construction unit is not in use. The component parts coupled to the anchor may be configured such that the storage component may be accessed, even in the collapsed configuration. As shown, the wall 206 is on a back side of the anchor and not on the storage space side, such that, even when collapsed, the storage space is still accessible. The system may therefore be used to convert between a personal space, such as for use in the evening for sleep, to a storage wall or area, such as for keeping personal belongings during the day. For example, the anchors may be in a deployed configuration and positioned in a spaced apart configuration with walls and frame there between to create enclosed or semi-enclosed personal spaces and hallways. Anchors may then be repositioned against a wall of a room so that storage areas are facing outward to define a storage wall against a side of the area previously used for the personal spaces. The area of the larger room may thereafter be vacated or largely vacated by the modular system to provide room for other activities, such as for serving food, having classes, etc. in which tables, chairs, or other furniture may be brought in to accommodate.

Figure 7:
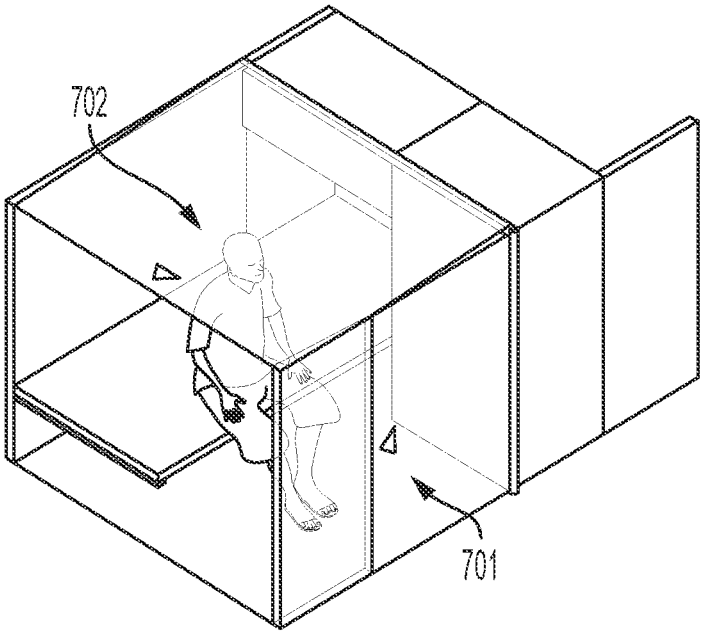
FIG. 7 illustrates an exemplary modular system in a deployed configuration according to embodiments described herein.

FIG. 7 illustrates an exemplary modular system in a deployed configuration according to embodiments described herein. As shown, other component parts may be coupled to the construction unit to provide additional benefits to a user. Other component parts may include a ceiling 702 provided over a top or between adjacent anchors. The ceiling may be planar boards that rest between adjacent anchors. Fasteners may be included to reduce or prevent accidental dislodgment of the ceiling from the anchors. Other component parts may include a door 701. The door may be hinged to the anchor and/or wall. The door may be slid along anchor and/or wall. The door and/or ceiling may be a planar, rigid construct. The door and/or ceiling may be a flexible construct. For example, the door and/or ceiling may be a heavy fabric to reduce light and sound while permitting easy construction. In an exemplary embodiment, the door and/or ceiling may be attached to an anchor, wall, or other component part by button, snaps, hook/loop fastener, hooks, mated surfaces, indents/detents, etc. In an exemplary embodiment, the ceiling and/or door are provided to add privacy to the enclosure, reduce external light and/or reduce noise within the personal space from outside the personal space.

Figure 8:
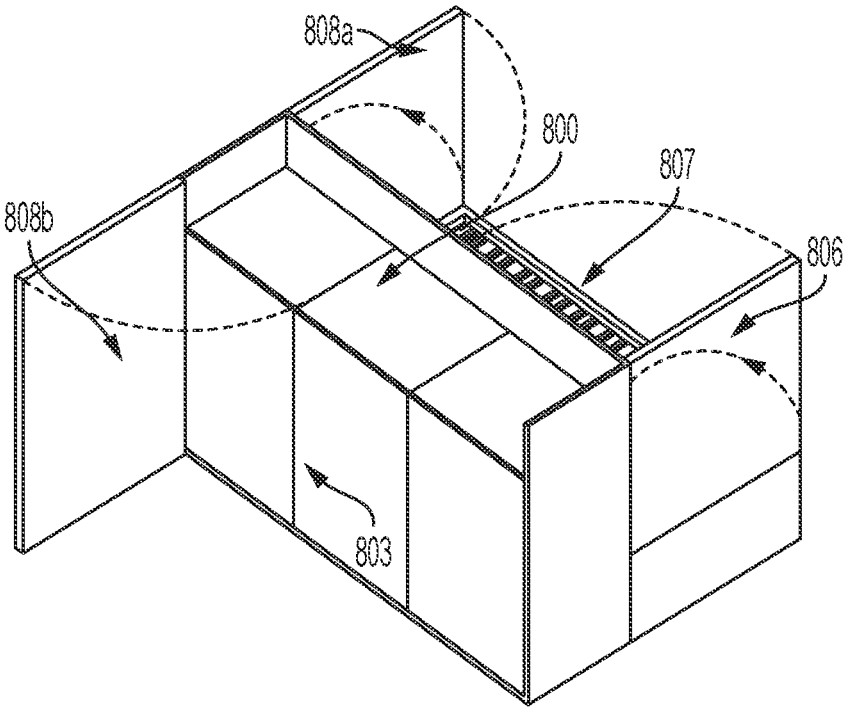
FIG. 8 illustrates an exemplary construction unit of a modular system in a deployed configuration according to embodiments described herein.

FIG. 8 illustrates an exemplary construction unit of a modular system in a deployed configuration according to embodiments described herein. As shown, anchor 800 may define different configuration of support structure, wall, and storage space. As shown, storage space 803 may encompass an entire side of the anchor 807. The storage space 803 may include any storage configuration including, for example, shelves, cabinets, drawers, etc. The anchor 800 may include a plurality of walls 808*a*, 808*b*, 806 coupled thereto. A pair of walls 806, 808*a* may be on a first side of the anchor. The pair of walls may be rotatably coupled to the anchor and may each include support structure for securing and/or supporting frame 807 there between. Support structures may include projections as described herein. Support structures may also include indentations in the surface, such as slots that correspond in inner dimension to an exterior dimension of the frame 807, such that a portion of frame 807 may be positioned therein. The anchor may include a third wall 808*b* on an opposite side of the anchor than the pair of walls. When two anchors are separated and positioned adjacent to each other, one wall 808*a* of the pair of walls and the third wall 808*b* may be aligned to define a single wall or planar surface for the enclosed personal space.

Different construction units may be used to define alternative units for creating different user spaces. Different combination of construction units may be used together to define different combination of personal space depending on the needs of the users. The personal space 803 of anchor 800 may be used similar to define an arrangement similar to previously described construction units. For example, one or more of the drawers or storage space may be removed and a support structure used to support the drawer may also support a frame inserted therein.

Figure 9:
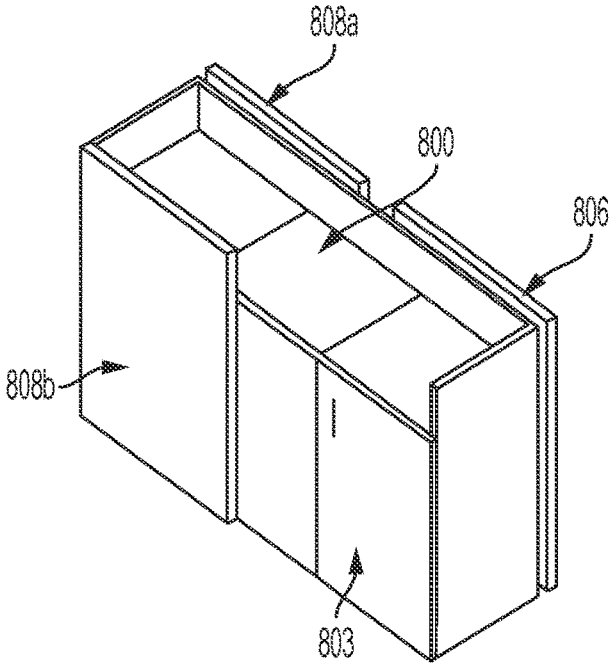
FIG. 9 illustrates an exemplary construction unit of a modular system in a collapsed configuration according to embodiments described herein.

FIG. 9 illustrates an exemplary construction unit of a modular system in a collapsed configuration according to embodiments described herein. As shown, the collapsed configuration of the anchor defined a planar surface on one side and an offset or stepwise planar surface on an opposing side. The stepwise planar surface may define a mating surface, such that two anchors may be positioned side by side or on top of each other and still lay flat and not slide off of each other. In this instant, a pair of anchors are used to define a storage configuration in which an outer profile of the pair of anchors in a storage configuration define the rectangular cubic outer profile.

Figure 10:
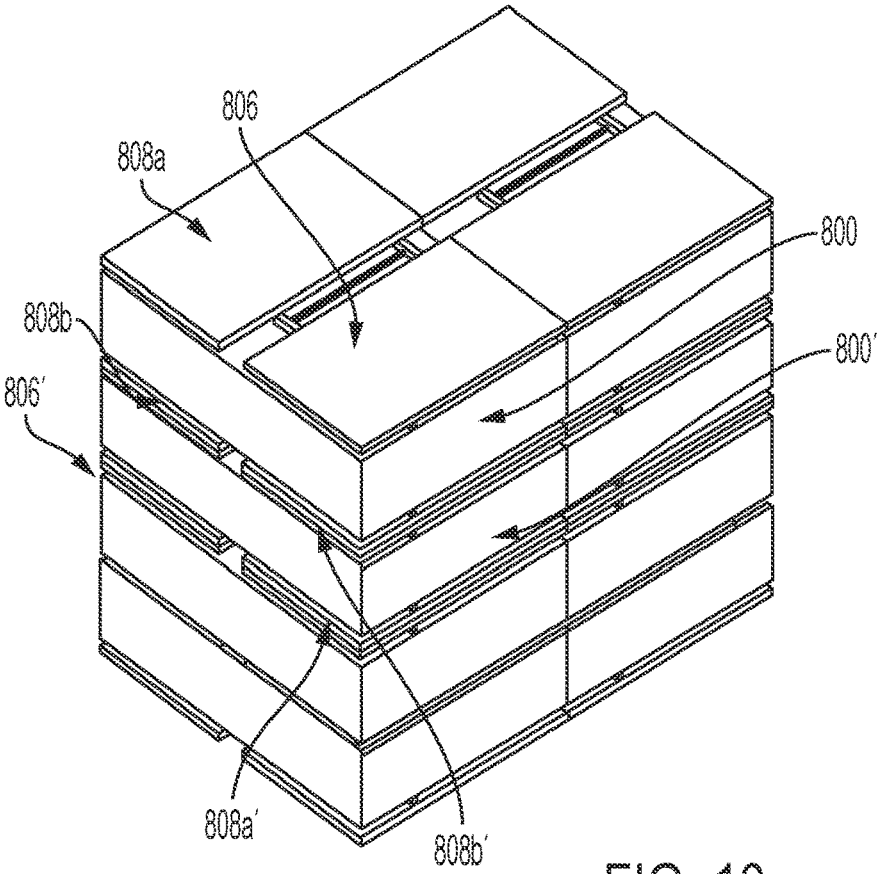
FIG. 10 illustrates an exemplary modular system in a stored configuration according to embodiments described herein.

FIG. 10 illustrates an exemplary modular system in a stored configuration according to embodiments described herein. FIG. 10 illustrates an exemplary embodiment of the mated stacking in which the pair of walls 806 and 808*a* define a planar surface in a collapsed configuration, and the third wall 808 of first anchor 800 and a third wall 808' of a second anchor 800 are positioned adjacent each other to define a singular planar surface. Therefore, adjacent anchors are rotated relative to each other to position in a mated configuration. When two anchors are positioned together, the pair of walls 808*a* and 806 of one anchor 800 and the pair of walls 808*a*' and 806' of the other anchor 800' are facing outward to define planar surfaces.

Figure 11:
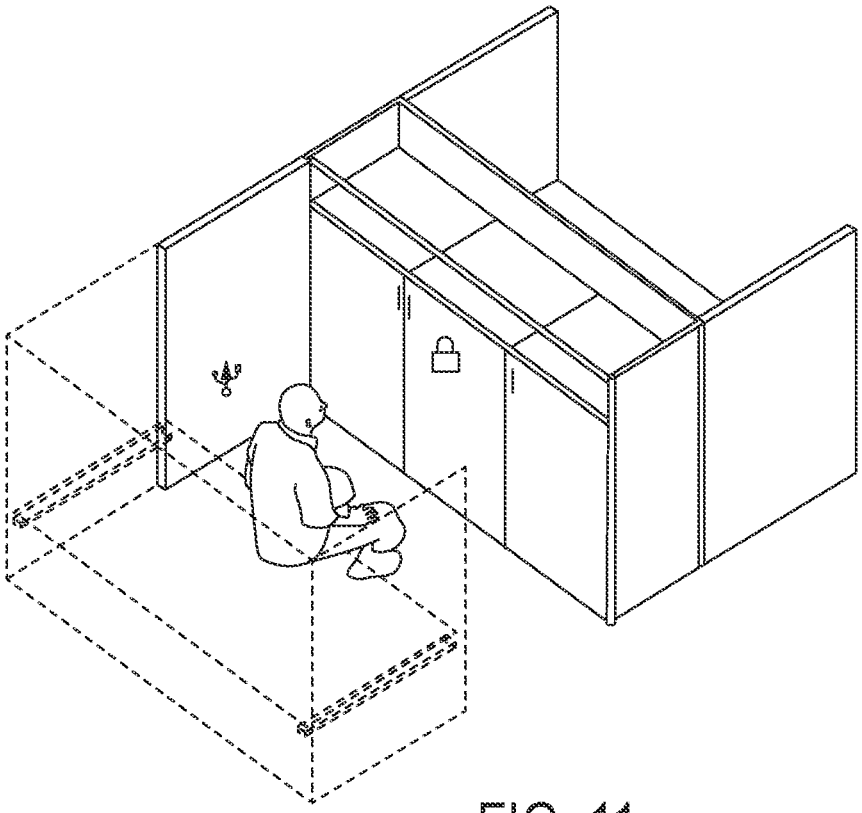
FIG. 11 illustrates an exemplary construction unit of a modular system in a deployed configuration according to embodiments described herein.

FIG. 11 illustrates an exemplary construction unit of a modular system in a deployed configuration according to embodiments described herein. As shown, the support structures between the pair of walls can be seen supporting a frame for use as a seat. The storage cavity is illustrated in another configuration for example. The wall(s) and/or anchor may include additional features as described herein, such as power, ports, locks, locking attachments, etc.

Figure 12:
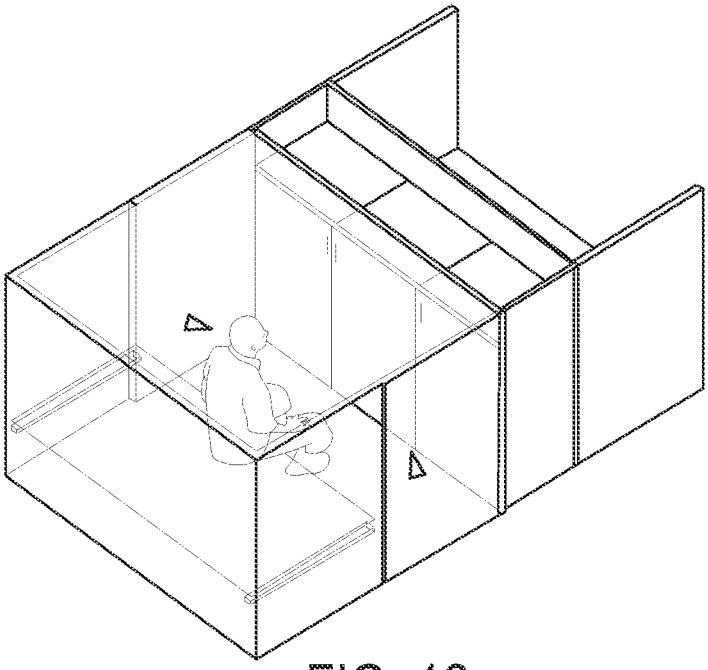
FIG. 12 illustrates an exemplary modular system in a deployed configuration according to embodiments described herein.

FIG. 12 illustrates an exemplary modular system in a deployed configuration according to embodiments described herein. As described herein, a modular system may include a door and/or ceiling according to configurations described herein.

Figure 13:
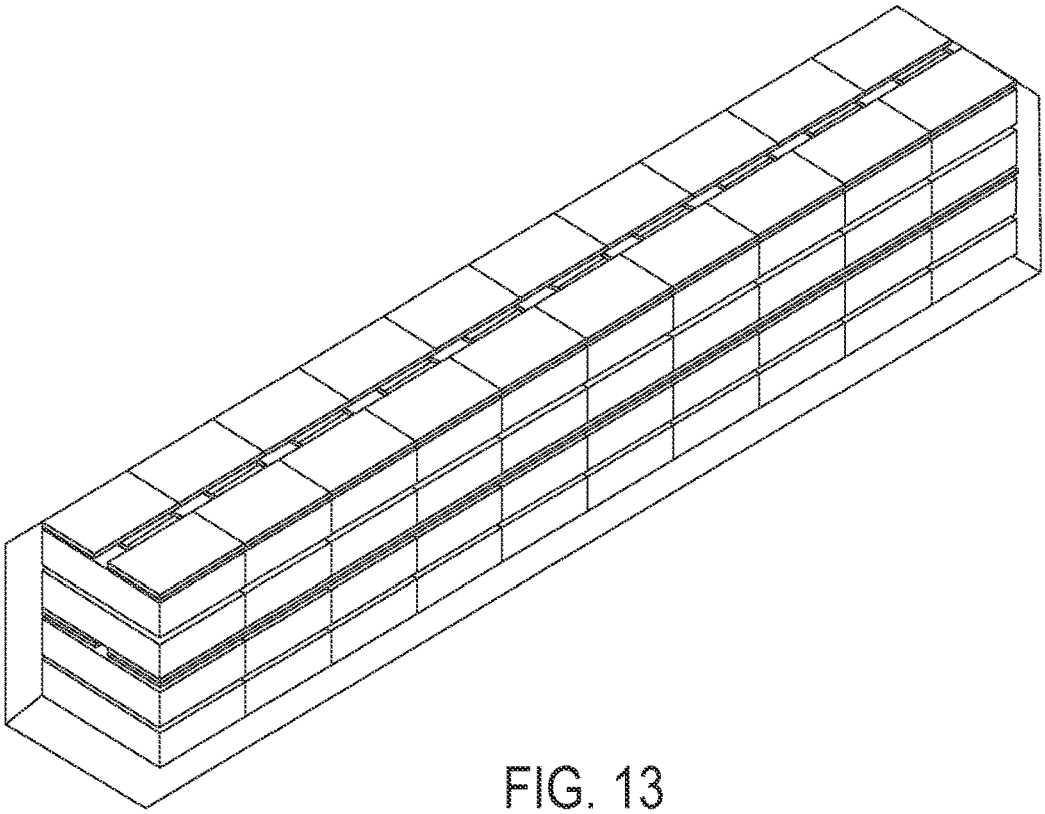
FIG. 13 illustrates an exemplary modular system in a stored configuration according to embodiments described herein.

FIG. 13 illustrates an exemplary modular system in a stored configuration according to embodiments described herein. As shown, the frame may be stored within the collapsed configuration of the anchor. The frame may be hinged to the anchor. The frame may be separated from and coupled to support structures as described herein. The support structures and/or hinge of the pair of walls may separate the wall from the anchor surface to position the frame therein.

Figure 14:
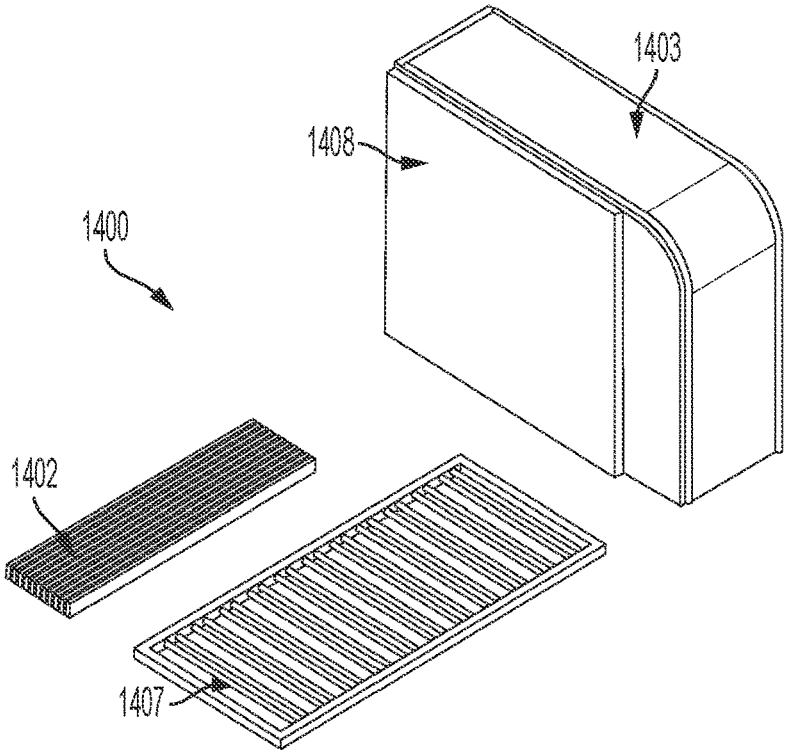
FIG. 14 illustrates an exemplary modular system in a collapsed, component part configuration according to embodiments described herein.

FIG. 14 illustrates an exemplary modular system in a collapsed, component part configuration according to embodiments described herein. Exemplary embodiments of the modular system according to embodiments described herein may include an anchor 1403, a wall 1408, a frame 1407, a cover 1402, and combinations thereof. The anchor, wall, and frame may be configured and/or have attributes described herein with respect to any embodiment described herein.

Figure 15:
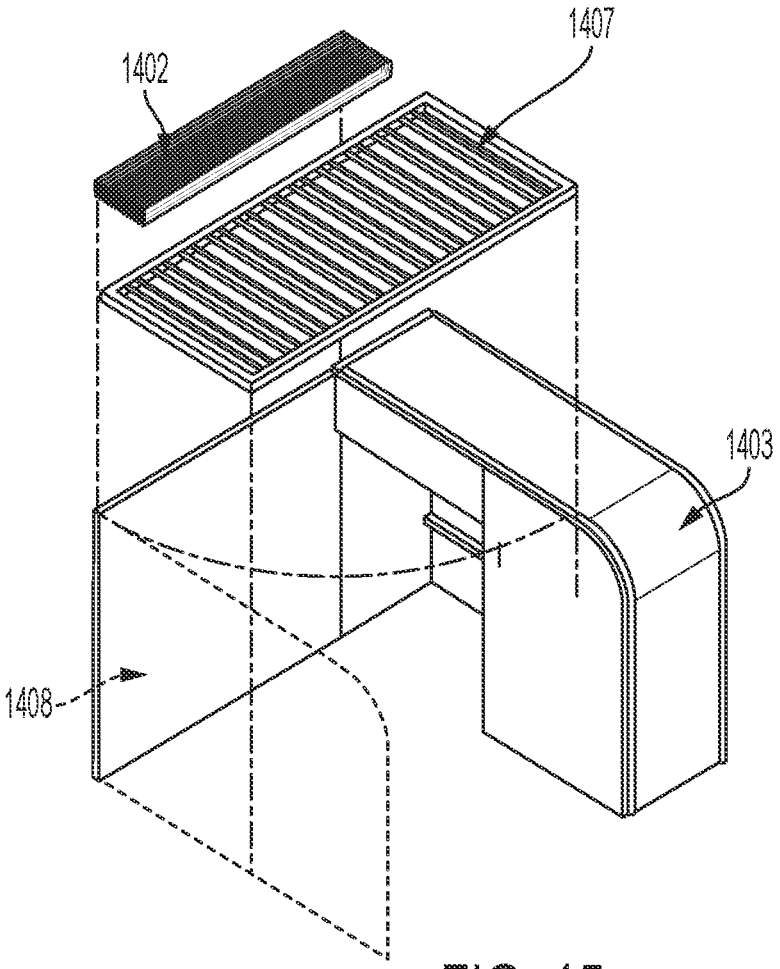
FIG. 15 illustrates an exemplary modular system in an exploded component part configuration according to embodiments described herein.

FIG. 15 illustrates an exemplary modular system in an exploded component part configuration according to embodiments described herein. The module system may be deployed similar to configurations described herein in which anchors 1403 are positioned sequentially with a wall 1408 positioned therebetween to define a continuous edge of a deployed arrangement. Opposing sides of the anchor may also include supports for positioning and securing the frame 1407 at a desired location and/or height. A plurality of supports may be provided to permit the frame to be positioned at various heights for use as a seating area, desk, bed, and combinations thereof. A plurality of supports may also be used to support a plurality of frames to create or define bunk beds and/or additional storage space above or below the bed.

Figure 16:
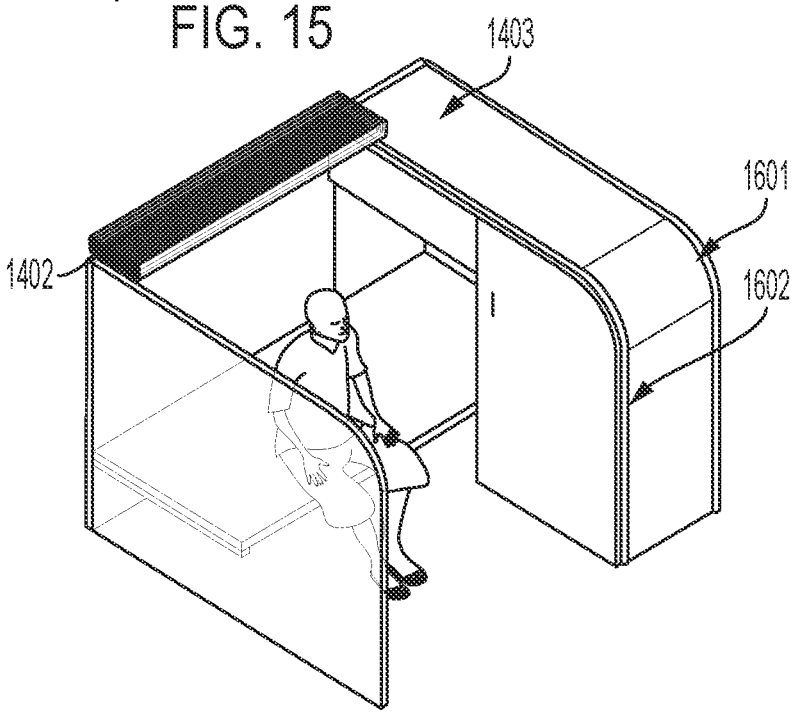
FIG. 16 illustrates an exemplary modular system in a deployed, fully open configuration according to embodiments described herein.

FIG. 16 illustrates an exemplary modular system in a deployed, fully open configuration according to embodiments described herein. As shown, the anchor 1403 may include a plurality of storage compartments that are covered, uncovered, or a combination thereof. The out edge of the anchor 1403 may include rail, track, or other mating feature 1601, 1602 to engage with ends of the cover 1402. As shown, the mating feature 1602 may support and permit the cover to attach to and/or move relative to the anchor. As shown, the anchor 1403 may have a continuous curvy-linear perimeter along the entire length of the mating feature, such that the cover may continuously, smoothly, and easily move along the frame without any discontinuities in travel path and/or direction. For example, the mating feature 1602 may be a railed track in which a portion of the cover fits therein. The cover may thereafter move along track along an entire length without traversing a 90 degree or hard cover or discontinuous redirection of the track. The cover may also include one or more portions that may be used together or separately to move along portions of the track. The track may be continuous or discontinuous along its length.

Figure 17:
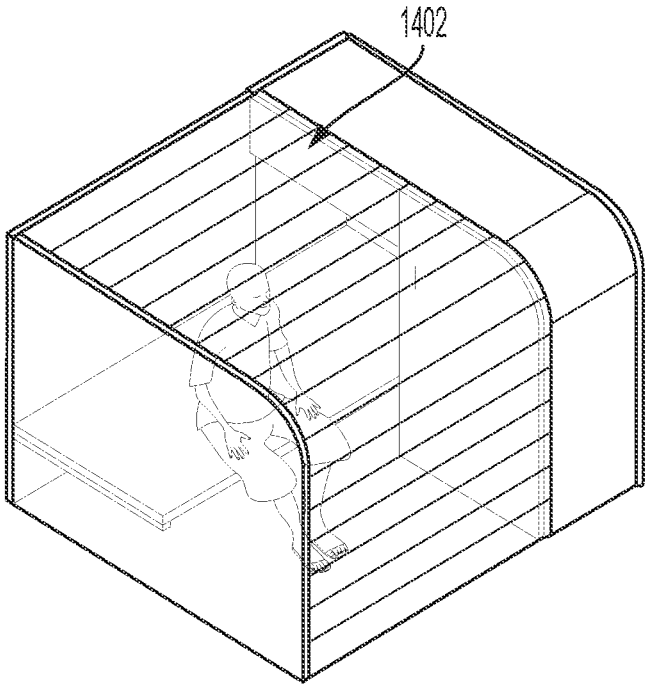
FIG. 17 illustrates an exemplary modular system in a deployed, fully closed configuration according to embodiments described herein.

FIG. 17 illustrates an exemplary modular system in a deployed, fully closed configuration according to embodiments described herein. As seen by a comparison of FIGS. 16 and 17, the cover 1402 may be repositioned relative to the mating feature 1602 such that different open and closed configurations of the defined space can be created. In an exemplary embodiment, the cover may slide along the mating feature. Other mating features may also be used, such as rails, interconnecting features, magnetic attraction, snaps, hooks, buttons, loops, hook and loop fasteners, or other mating features.

Figure 18:
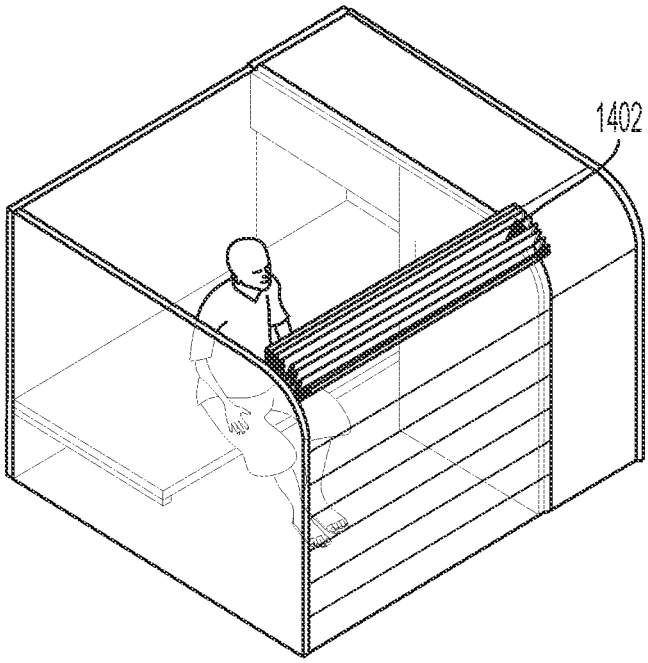
FIG. 18 illustrates an exemplary modular system in a deployed, partially closed configuration according to embodiments described herein.

FIG. 18 illustrates an exemplary modular system in a deployed, partially closed configuration according to embodiments described herein. In an exemplary embodiment, the cover may be relative to the mating feature in any combination of directions. Therefore, as shown, the cover may be used as a wall only to defined a continuous, closed, perimeter around the interior space with adjacent anchors and the wall; the cover may be used as a ceiling only to cover an overhead of the interior space defined between adjacent anchors, may be used as both a ceiling and wall to fully enclose an interior space between adjacent anchors; or other configuration. As shown, the cover may be collapsible by being folded back and forth on itself or extendable by separating the folds and reconfiguring the cover in a generally planar or flatted configuration. Other configurations may also be used, such as an elastic cover, rolling the cover, or creating other collapsed and expanded configurations.

In an exemplary embodiment, such as seen in FIG. 18, the cover may be configured to traverse and/or attach to a front or lateral side of the exemplary modular system, while leaving an area at the top or corresponding to a ceiling area of the module open. In an exemplary embodiment, the deployed modular system comprises of an open top. The open top of the module may facilitate fire and safety procedures and infrastructure. For example, the open top may permit access to an interior of the deployed module by sprinkler and other fire suppression systems that may be incorporated into the building structure in which the module is deployed. The open top may also facilitate variability in occupant height. For example, a module, when deployed, may have an approximate height of 5-7 feet. The modules may be occupied by users having a greater height in which the open top permits comfortable maneuvering within the module. The open top may also assist with other safety or comfort design considerations, such as a tear away or easily removable covering, as described herein.

Figure 19:
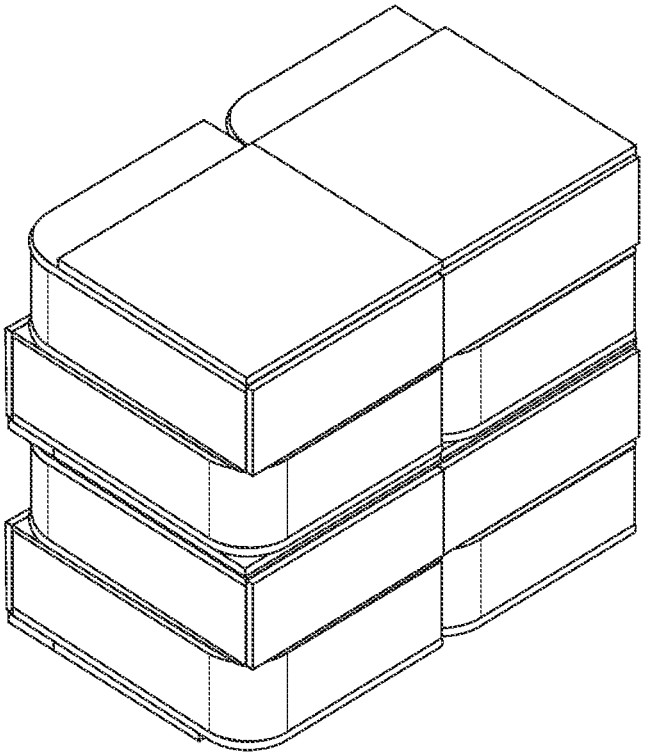
FIG. 19 illustrates an exemplary modular system in a stored configuration according to embodiments described herein.
Figure 20:
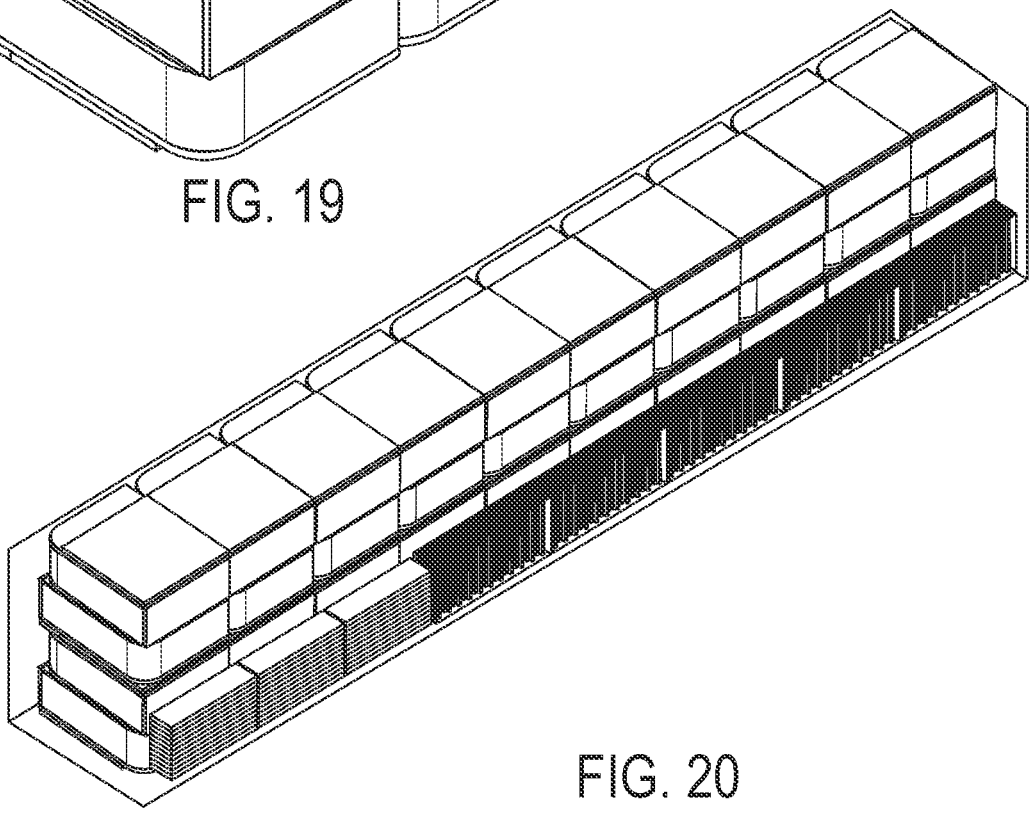
FIG. 20 illustrates an exemplary modular system in a stored configuration according to embodiments described herein.

FIG. 19 illustrates an exemplary modular system in a stored configuration according to embodiments described herein. FIG. 20 illustrates an exemplary modular system in a stored configuration according to embodiments described herein. Exemplary embodiments may be collapsed into a storage position and a plurality of modules stacked together to define a storage volume.

Figure 21:
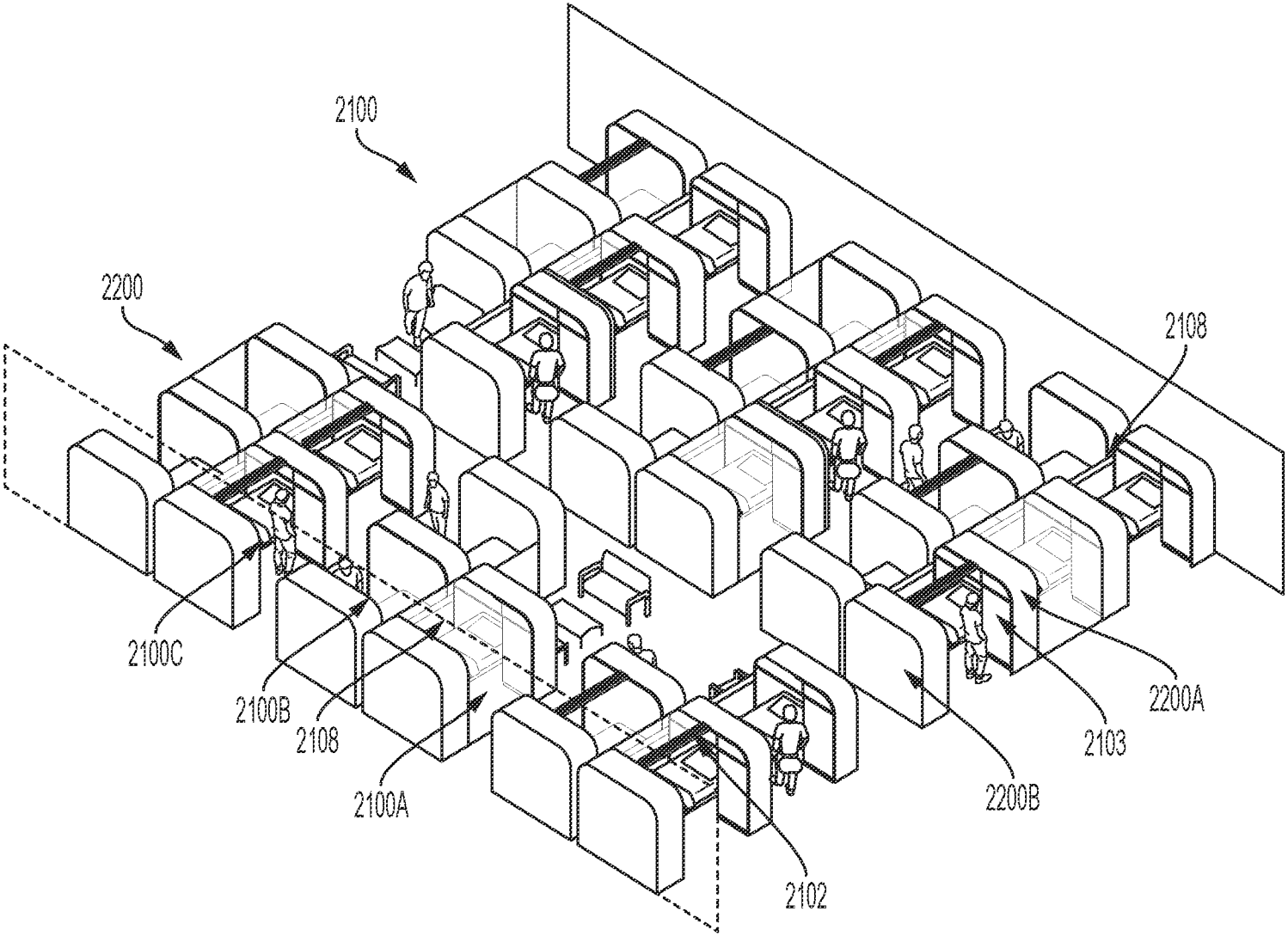
FIG. 21 illustrates an exemplary modular system in a deployed configuration as used to create a plurality of individual living spaces.

FIG. 21 illustrates an exemplary modular system in a deployed configuration as used to create a plurality of individual living spaces. Exemplary module living spaces may be created by selectively positioning modular unites about an enclosed volume. For example, a plurality of individual living spaces may be created from a plurality of modular units 2100 positioned adjacent each other. Exemplary module units may be positioned in rows to define hallways there between and a grid of individual living spaces. Areas of the enclosed volume may not include module units and/or living spaces to create walkways there through. Other spaces may also be positioned within the enclosed volume, such as for seating, gathering, cooking, storage, etc. As illustrated, siting areas are created where individual living spaces are not created and seating and tables are provided.

Family or multiple person units may be created by including a plurality of bedding furniture over each other vertically, and/or in coupling adjacent individual living spaces together. Coupling adjacent individual living spaces together may be achieved by lowering or removing an intervening wall between adjacent individual living space units and/or in providing an additional covering to extend over or between adjacent units. For example, a larger or multiple-person living space may be created between individual living spaces 2100A and 2100B by lowering and/or removing the wall 2108 between adjacent units. A covering 2102 may then be used across each individual units and selectively positioned to create an opening between adjacent units or a single covering may extend across adjacent units to enclose the adjacent units and device a single living space therein. As another example, a larger or multiple-person living space may be created between individual living spaces 2100B and 2100C by using one or more coverings to extend across and between adjacent units that may be positioned on opposing sides of a walk or hallway space. A covering, not shown, may be extended across that walkway between adjacent anchors defining ends of living spaces 2100B and 2100C. As another example, the individual living spaces 2100A, 2100B, 2100C do not change, but in which a group or space is created in housing related persons together in the same area and/or adjacent or proximate locations, i.e. the position of families or individuals may be strategically selected.

Figure 22:
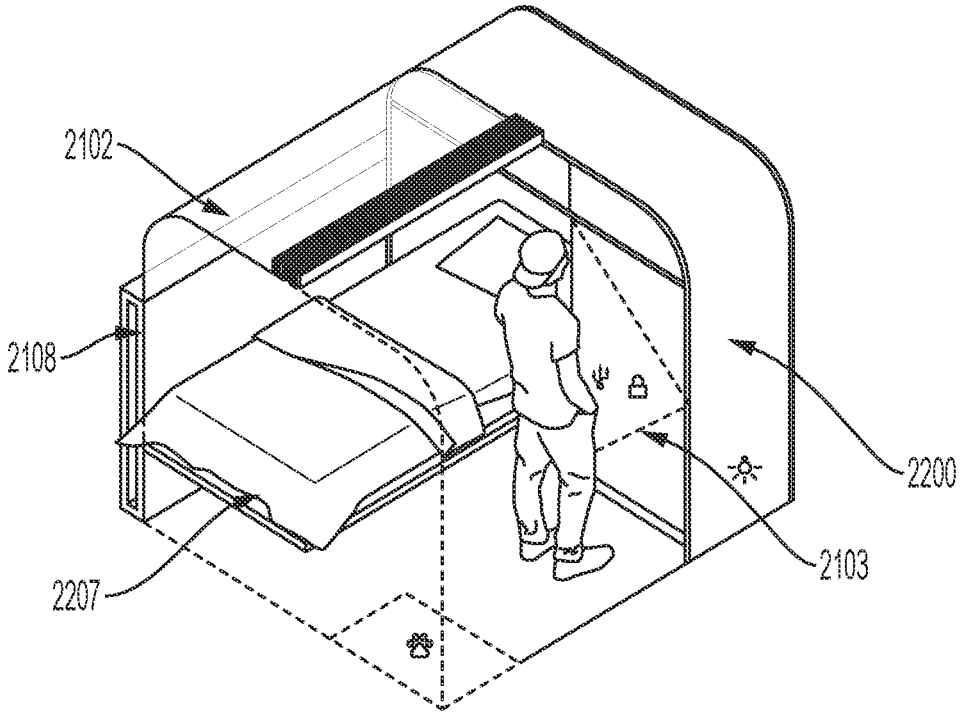
FIG. 22 illustrates an exemplary modular unit of FIG. 21.

FIG. 22 illustrates an exemplary modular unit of FIG. 21. The module units may include one or more anchors 2200 in which living space furniture may be positioned there between. The module units may also include a closure 2102 to cover at least a portion of the space between adjacent anchors 2200. As illustrated the anchors 2200 may define storage space 2103. The storage space may be an enclosure with a door or other covering or may be open, such as in shelf space. In an example embodiment, the covering may be secured and/or lockable to protect the valuables of the individual using the individual living space. Other exemplary securable enclosures may include doors, drawers, sliders, etc. For example, a door may extend across an enclosure and may include openings to permit a lock of the individual to pass there threw and secure the door in a closed and locked position. The anchor may include a recess for accommodating a portion of a sleeping structure, such as frame 2207. The recess may include a projection, ledge, or other support structure for retaining and supporting the frame 2207. In an exemplary embodiment, the frame 2207 may be a separate support from the modular unit or anchor and may be positioned on the floor and fit within the recess of the anchor. The sleep structure may be any furniture or other item, such as futon, chair, couch, open area, etc. The space may accommodate mats, cots, hammocks, frames, etc. An exemplary closure 2102 may be used to fully or partially enclose the space between adjacent anchors to define and create the individual living space. The covering may be any enclosure, such as fabric, plastic, etc. The covering may be in a rolled configuration to extend out of one or both ends of a dispenser. The covering may be pleated to permit the covering to include a compressed or compact configuration and an extended or deployed configuration. The covering may extend along rails, or may include zippers, slider, buttons, snaps, hook and loop, hook and opening, track, grommets, or other connection to couple the covering to the anchor or other component of the individual living space. The covering may be a curtain that is hung between an extension between adjacent anchors.

As illustrated in FIG. 21, the module system may be deployed as a plurality of module units. An individual living space may be defined or created between two adjacent, parallel aligned anchors. In an exemplary embodiment, the adjacent anchors may be of the same shape, configuration, and direction, such that the living space is made of two identical anchors 2200A. In this way the deployment as a system to create a plurality of living spaces may be more efficiently achieved and maintenance and replacement of anchors may be easier. In this case, each anchor may be the same and therefore completely interchangeable. In an exemplary embodiment, there may a second anchor 2200B that has a second or different configuration as the remaining anchors. The second anchor 2200B may be an end anchor that includes a blank or other end configuration. The second anchor 2200B may be configured as an anchor for an end of an adjacent, sequential, series of anchors defining a plurality of living spaces along the line of anchors. The second anchor 2200B may be configured as a group space and provide additional storage, charging capabilities, etc. that may be used by the residence of the community created by the plurality of living spaces.

As illustrated, a wall 2108 may be positioned between adjacent anchors to separate a living space on opposing sides of the wall. The wall may be a module component part or may be a built in fabricated into the space to be converted into a temporary living space. The wall may be fabricated to provide more privacy and/or noise damping between adjacent units. The wall may be fabricated to provide electrical lines along the wall to permit power to run to the individual living space units, such as through the anchor. In an exemplary embodiment, the wall may be a dry wall partition that carries electrical conduit. In an exemplary embodiment, the wall may be a modular partition that carries electrical conduit.

As seen in FIG. 22, the anchor may include power connections for use by the individual. In an exemplary embodiment, the anchor 2200 may include outlets or other ports for electrically coupling objects. For example, the anchor may include USB ports for charging mobile electronic devices. The anchor may include AC power port for plugging in electrical device. The anchor may include electronic devices, such as lights. The lights may be provided on an interior of the individual personal space for illuminating the space when enclosed. For example, a light may be positioned within the recess for supporting and/or accommodating the bedding. A light may be positioned within enclosure for retaining and securing personal items to illuminate the enclosed space. A light may be positioned on an exterior edge of the anchor to provide illumination outside of the individual living space, such as for illuminating common areas and/or walkways between enclosures. The lights may include switches for turning the lights on and off, and/or may be automatically run. The anchor may include a sensor for detecting a light level within an area or space. The sensor may be used to control when a light of the anchor is turned on and off. The anchor may also include rechargeable power supply, such as through solar, and/or battery operation to power the one or more electronic devices on the anchor, such as the lights. Other sensors may also be used, such as in motion sensors to control the lights or other electronics of the anchor.

Figure 23:
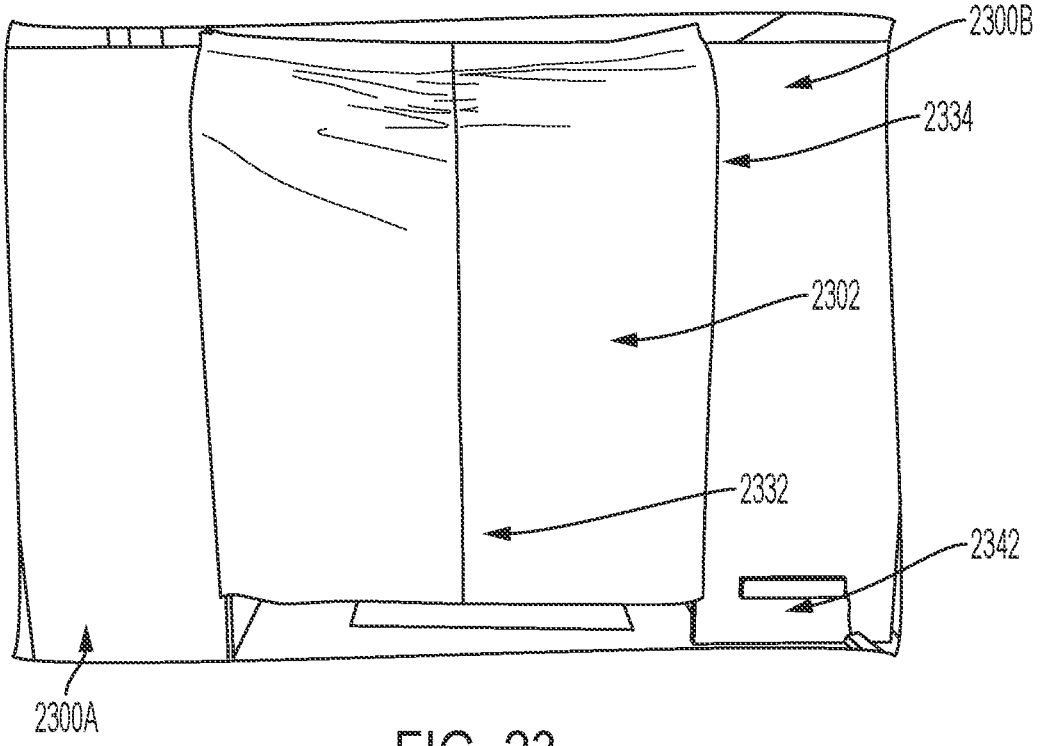
FIG. 23-27 illustrates features of an exemplary covering according to embodiments described herein.

FIG. 23 illustrates an exemplary system deployed to define a user living space. The system includes a first anchor 2300A and a second anchor 2300B. The anchors may be the same or different shape, configuration, features, etc. As illustrate, an anchor may include a light 2342 proximate the floor of the system to permit lighting along walkways. The lights may be colored, shaped, or otherwise different to indicate exit or main pathways as opposed to aisle pathways.

FIG. 23-27 illustrates features of an exemplary covering according to embodiments described herein. A covering 2302 may be configured to extend and traverse a space between adjacent anchors 2300A, 2300B. The covering may be optional. In covering may include a closable/openable access. As illustrated, the covering includes a first portion and a second portion with an attachment feature to permit the repeatable attachment between the first portion and the second portion. The first portion and second portion may be configured and oriented such that a vertical gap or space may be created between the first portion and second portion to permit passage by an individual there between. As illustrated, the attachment feature is a zipper. Other attachment features may also be used, such as, for example, buttons, snaps, friction attachment, hook or loop or eye fasteners, etc.

Figure 24:
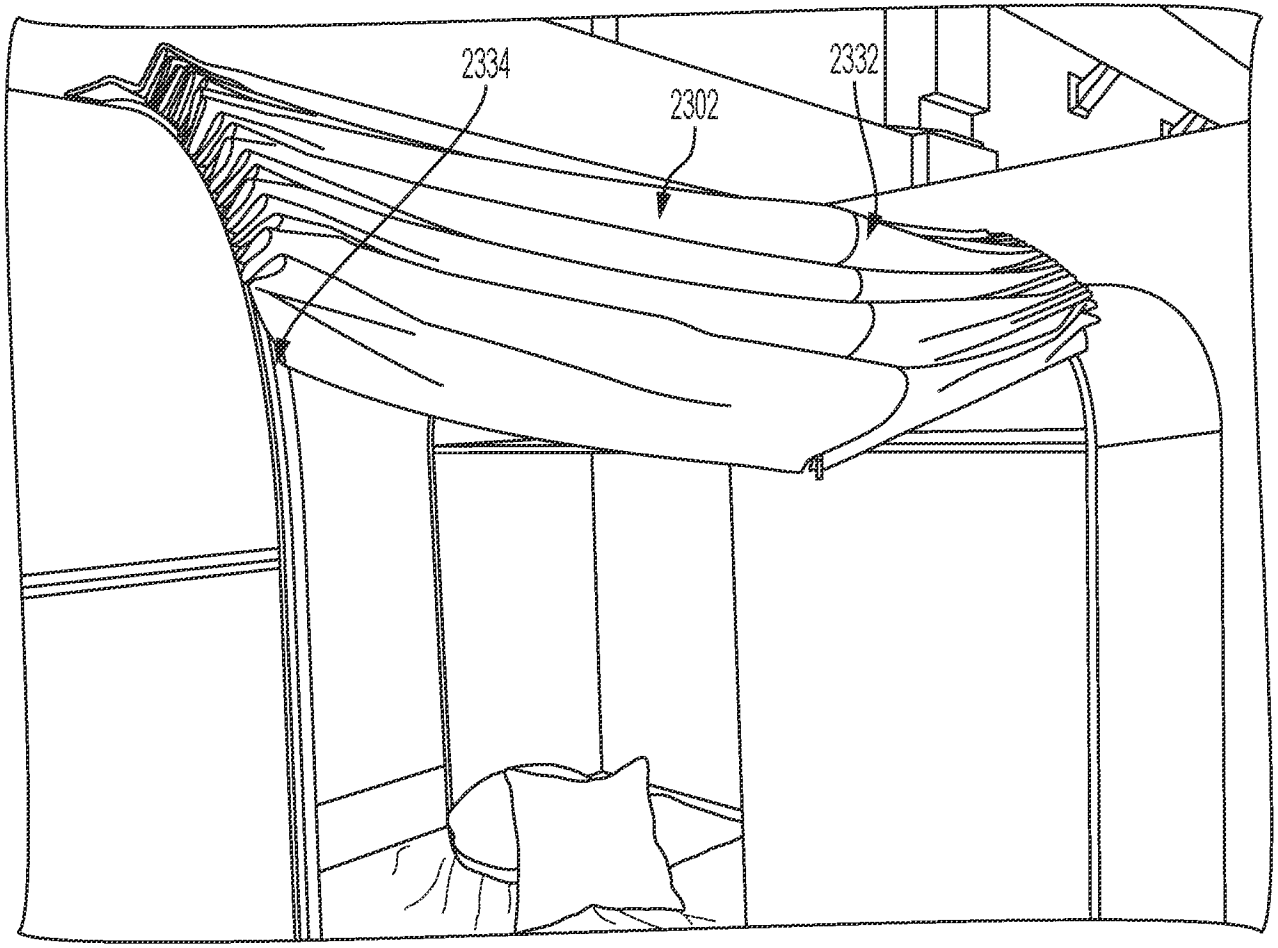

In an exemplary embodiment, the covering 2302 may be attached to an anchor 2300B. As illustrated, the attachment may be removable and/or movable. As seen in FIG. 24, the covering 2302 may be coupled to the anchor on a rail 2334. The rail may permit the curtain to traverse along a direction or directions. As illustrated, the rail 2334 is positioned along an edge of the anchor and permits the covering to travel along the rail.

Figure 25:
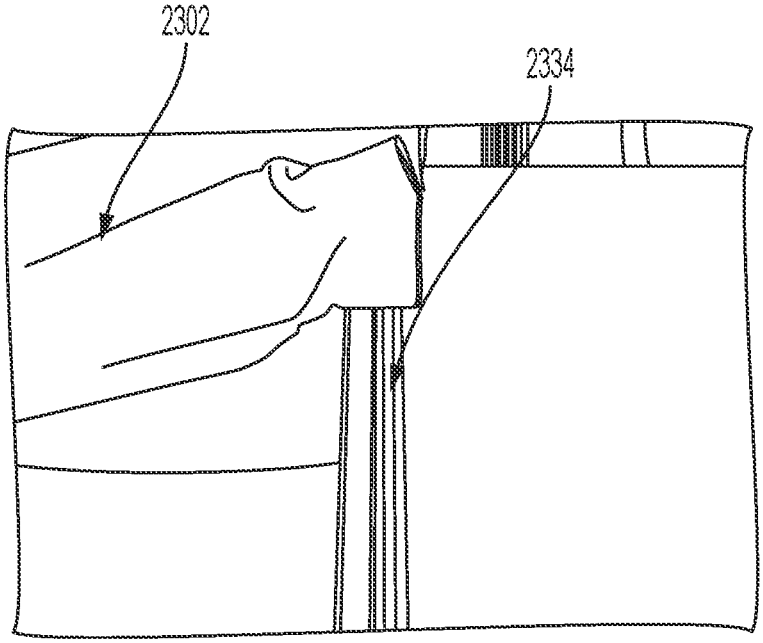
Figure 26:
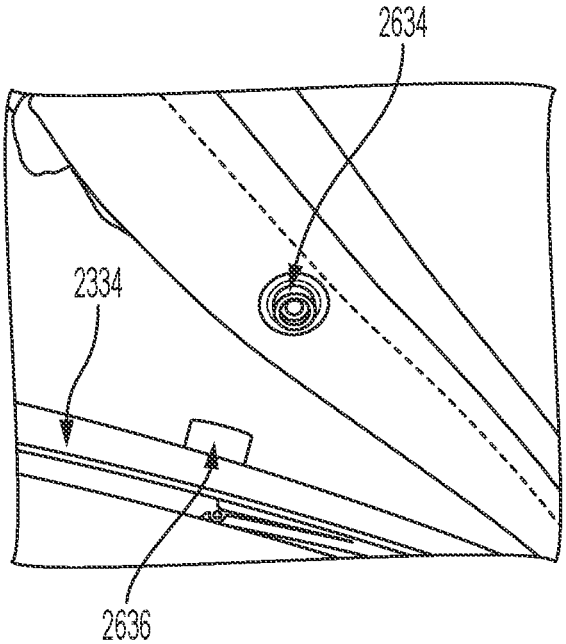
Figure 27:
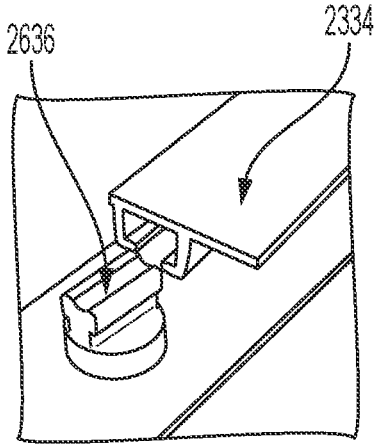

FIG. 25 illustrates an exemplary close up of the rail. The rail may include a track with opposing sides in which a connector 2636 is positioned. The connector 2636 may be configured to fit within the rail and slide along the rail. FIG. 27 illustrates an exemplary interface between connector 2334 and connector 2636 in which rail 2334 includes opposing flanged projections in which the projections fit within recess of connector 2636. The connector and rail may contact to create a frictional engagement there between. In an exemplary embodiment, the connector 2636 is frictionally engaged with the rail 2334 such that a relative position of the connector to the rail is maintained, even under a weight of the covering. An individual may translate or slide the connector along the rail with an application of force. As illustrated in FIG. 26, the connector 2636 may be coupled to the covering. The coupling may be permanent, semi-permanent, or removable. As illustrated, the coupling may be removable. The removable attachment may facilitate washing of the covering, or may permit tear away removal in the event a user needs to exit the enclosed space quickly or if the individual is caught in the covering. As illustrated the rail includes a first connector 2636 and the covering 2302 includes a second connector 2634. The first and second connectors may mate or permit removable attachment there between. As illustrated, the first and second connectors are mated pairs of a snap. Other connectors may also be used, such as, for example, hook or eye or loop, buttons, snaps, frictional engagements, mated surfaces, etc. The covering and rail may include a plurality of connectors along a length to remote the attachment of the covering to the anchor at a plurality of locations.

As illustrated, the system may include one or more repeatable anchor systems. The anchors may be the same and positioned one after another to define a plurality of adjacent individual living spaces. The anchor may include a first side that create or defines a storage area and/or a recess for accommodating a portion of a bedding structure. The anchor may include a second side opposite the first side for supporting another end of the bedding structure such that the bedding structure extends between adjacent parallel anchors. As illustrated, different anchors may be provided, such as for end of unit anchors. The end of unit anchors may define separate shapes or configurations, for example, when a bedding structure is not supported by the end anchor on both sides of the end anchor. Alternatively, a anchor may be configured or created, such that a door or covering may be positioned across the recess for support the bedding structure. The support for the bedding structure may instead support a shelf or other storage structure. The end anchor may therefore comprise the same structure as any other anchor used within the system, but may include an additional covering to create a closed end structure for the row of individual living spaces. The end anchor may be used for additional storage for the occupants or for supplies to be used by the housing facility or organization. For example, extra blankets and bedding materials may be supported and retained in the end units in place of a bedding structure. The anchor may therefore include a hinge or support for which a covering may be included on one or both sides of the anchor for creating either a shelf, storage space, or bedding support structure.

Exemplary embodiments include a modular system for creating a temporary plurality of individual living spaces. The modular system may include a plurality of anchors, an anchor configured to be positioned parallel to at least one other anchor to create a pair of adjacent parallel anchors to define an individual living space between the adjacent parallel anchors. The modular system may include a plurality of frames in which a frame is positioned between the pair of adjacent parallel anchors to provide a bedding structure. The modular system may include a plurality of coverings in which a covering may be used to enclose the space between the pair of adjacent parallel anchors to create enclose the space between the pair of adjacent parallel anchors. The covering of the plurality of coverings may be configured to extend an entire space between adjacent parallel anchors. The covering may be configured to have a first position to extend over an opening permitting ingress and egress into the individual living space and a second position exposing the opening. The plurality of anchors may have a first side having a first support and a second side opposite the first side having a second support so that a frame can be supported on the first support of a first anchor of the pair of adjacent parallel anchors and the second support of a second anchor of the pair of adjacent parallel anchors. Each of the plurality of anchors may include a recess and a storage compartment on the first side, and the where the first support can be positioned within the recess. The first support can be a projection out of a surface of the recess and the second support can be a projection out of a second surface of the second side. Each of the plurality of anchors can include an electrical port for providing power to an electronic device, and/or one or more lights. For example, a light may be positioned on an exterior surface of the anchor between the first side and the second side.

As illustrated in FIG. 21, an open space may be converted into a temporary living area for a plurality of individuals using embodiments described herein. In an exemplary embodiment, a plurality of anchors may be positioned within an enclosed space, such as a room. The plurality of anchors may define generally planar surfaces in which one side includes storage area and a recess. The plurality of anchors may be positioned in parallel orientation along a line to define a row. A frame may be positioned between adjacent anchors in a row to create a bedding structure. In an exemplary embodiment, the frame may be supported within the recess of the anchor and extend across an opening to an adjacent anchor. In an exemplary embodiment, the frame may be support on the ground. An individual living space may be enclosed by a covering positioned between adjacent anchors to fully or partially enclose a volume between adjacent anchors. In an exemplary embodiment, a plurality of anchors may be positioned such that each anchor is parallel to each other anchor, and the anchors are positioned in two or more rows, creating a grid of anchors. The grid may be aligned parallel and/or perpendicular to the orientation of the anchor. In an exemplary embodiment, two anchors may be positioned parallel to each other and separated such that each anchor is in a parallel plane separated from an adjacent anchor by a space. In an exemplary embodiment, the space may be sufficient to accommodate a bedding structure. Between parallel, adjacent anchors may be a covering that extends an entire length of the space between anchors. The covering may extendable such that it may define a deployed configuration such that the covering extends an entire length between adjacent anchors and may extend in a direction perpendicular to the length between adjacent anchor, such that the covering extends along a perimeter length of the anchor. The covering may be collapsible such that is may define a collapsed configuration such that the covering extends an entire length between adjacent anchors and may extend in a direction perpendicular to the length between adjacent anchors, such that the covering extends a lesser distance along the perimeter length of the anchor than in the deployed configuration. The covering of the deployed configuration may cover an opening between adjacent anchors preventing or reducing entrance into an interior space between adjacent anchors. The covering of the collapsed configuration may move the cover out of the opening between adjacent anchors to permit entrance into an interior space between adjacent anchors. In an exemplary embodiment, the covering may be changed from the collapsed configuration to the expanded configuration by moving the covering along a perimeter of the anchor and/or in a vertically up and down direction. Exemplary embodiments may include providing a space between parallel anchors that are in plane with an adjacent anchor to form a path or walkway there between.

Embodiments described herein include a method of creating a plurality of individual living spaces from an open enclosure. The method may include positioning a plurality of anchors such that an anchor is positioned parallel to at least one other anchor to create a pair of adjacent parallel anchors to define an individual living space between the adjacent parallel anchors. The method may include providing a frame between the pair of adjacent parallel anchors to create a bedding structure. The method may include configuring a covering between two parallel anchors to create an entire space between adjacent parallel anchors. The method may include positioning the covering in a first position to extend over an opening to hinder ingress and egress into the individual living space; and positioning the covering in a second position exposing the opening to permit ingress and egress into the individual living space. The frame may be provided between the pair of adjacent parallel anchors by supporting the frame on a first support on a first side of a first of the pair of adjacent parallel anchors and supporting the frame on a second support on a second side of the second of the pair of adjacent parallel anchors. The method may include providing any combination or number of pairs of adjacent anchors to create any desired number of individual personal living spaces.

As illustrated, for example in FIG. 21, the anchors may be configured to create individual living spaces. The individual living space may be created in adjacent and linear rows. In an exemplary embodiment, a line of uninterrupted living spaces may be created. The line of uninterrupted living spaces may include 1-4 living spaces and preferable 1-3 living spaces in the line. Another line of uninterrupted living spaces may be configured parallel and along the first line of uninterrupted living spaces. The first line and second line may be separated to create a space there between. The first line and second line of living spaces may therefore be created across from each other. In an exemplary embodiment, a third and/or fourth line of uninterrupted living spaces may also be created by a plurality of anchors positioned in a row to create additional lines of living spaces. These lines of living spaces may be extensions and positioned along the lines of the first and/or second line of uninterrupted living spaces. These third and fourth lines may be separated by a gap from the first and second lines. The gap may be used as a walkway between the living spaces. In an exemplary embodiment, the gap between living spaces parallel, adjacent, and along each other (e.g. such as between the first line and second line) may include a first space smaller than the gap between the living spaces parallel, along, and an extensions of another line of living spaces (e.g. such as between the first line and third line). The use of the spaces between living spaces may be used to define primary and secondary walkways. For example, a primary walkway may be created throughout the entire room from one end to another, while a plurality of secondary walkways may extend from the primary walkway and may be used to access only a subset of living spaces. A width of the secondary walkway may be less than the width of a primary walkway. The selection of a width of the secondary walkway may also be used to facilitate privacy within the living spaces.

Although embodiments of this invention have been described with reference to the accompanying drawings, it is to be noted that various changes and modifications will become apparent to those skilled in the art. Such changes and modifications are to be understood as being included within the scope of embodiments of this invention as defined by the appended claims.

What is claimed is:

1. A modular system for creating a temporary plurality of individual living spaces, comprising:

a plurality of anchors, an anchor of the plurality of anchors configured to be positioned parallel to at least one other anchor to create pairs of adjacent anchors to define individual living spaces between the pairs of adjacent anchors; and a plurality of frames in which a frame of the plurality of frames is positioned between and supported by respective pairs of adjacent anchors to provide a horizontal structure wherein each of the plurality of anchors comprising a track along a vertical length of the anchor, and a covering is coupled to the track of each of the adjacent anchors to extend between the adjacent anchors, wherein the covering is configured to move vertically relative the adjacent anchors to provide an opening or to close the opening between the pairs of adjacent anchors, and further wherein the track is along an edge of the anchor and comprises a continuous curvy-linear portion of a perimeter of the anchor along a side of the anchor and along at least a portion of a top of the anchor such that when the covering is coupled to the anchor, the covering acts as a ceiling to an individual living space of the plurality of individual living spaces created between adjacent anchors.

2. The module system of claim 1, wherein the covering is configured to extend and attach between a pair of adjacent parallel anchors to partially enclose respective ones of the individual living spaces.

3. The modular system of claim 2, wherein the covering is configured to extend an entire space between adjacent anchors, the covering is configured to have a first position to extend over an opening permitting ingress and egress into the individual living space and a second position exposing the opening.

4. The modular system of claim 2, wherein each of the plurality of anchors comprises a first side having a first support and a second side opposite the first side having a second support, wherein the frame is supported on the first support of a first anchor of the pair of adjacent anchors and the second support of a second anchor of the pair of adjacent anchors.

5. The modular system of claim 4, wherein each of the plurality of anchors includes a recess and a storage compartment on the first side, wherein the first support is positioned within the recess.

6. The modular system of claim 5, wherein the first support is a projection out of a surface of the recess and the second support is a projection out of a second surface of the second side.

7. The modular system of claim 6, wherein each of the plurality of anchors comprises an electrical port for providing power to an electronic device.

8. The modular system of claim 7, wherein each of the plurality of anchors comprises a light.

9. The modular system of claim 8, wherein the light is positioned on an exterior surface of the anchor between the first side and the second side.

10. The module system of claim 9, wherein each of the adjacent anchors includes the track and the covering comprises a connector positioned within the track to traverse along the track.

11. The module system of claim 10, wherein the covering comprises a second connector configured to removable attach to the connector positioned within the track.

12. The module system of claim 11, wherein the covering includes a first portion and a second portion and the first portion and the second portion are removably attached to each other and when unattached provide an opening within the covering.

13. A method of creating a plurality of individual living spaces from an open enclosure, comprising: positioning a plurality of anchors such that an anchor of the plurality of anchors is positioned parallel to at least one other anchor to create a pair of adjacent parallel anchors to define an individual living space between the adjacent parallel anchors wherein each of the plurality of anchors comprising a track along a vertical length of the anchor, and a covering is coupled to the track of each of the adjacent anchors to extend between the adjacent anchors, wherein the covering is configured to move vertically relative the adjacent anchors to provide an opening or to close the opening between the pairs of adjacent anchors, and further wherein the track is along an edge of the anchor and comprises a continuous curvy-linear portion of a perimeter of the anchor along a side of the anchor and along at least a portion of a top of the anchor such that when the covering is coupled to the anchor, the covering acts as a ceiling to an individual living space of the plurality of individual living spaces created between adjacent anchors; providing a frame between and supported by the pair of adjacent parallel anchors to create a bedding structure.

14. The method of claim 13, further comprising:

positioning the covering in a first position to extend over an opening to hinder ingress and egress into the individual living space; and positioning the covering in a second position exposing the opening to permit ingress and egress into the individual living space.

15. The method of claim 14, wherein the providing a frame between the pair of adjacent parallel anchors comprises supporting the frame on a first support on a first side of a first of the pair of adjacent parallel anchors and supporting the frame on a second support on a second side of the second of the pair of adjacent parallel anchors.

16. The method of claim 15, wherein each of the anchors of the plurality of anchors comprises the same shape, and each of the anchors of the plurality of anchors comprise the first side having the first support and the second side opposite the first side having the second support.

17. The method of claim 16, wherein each of the anchors comprises a power source for providing electricity to an electronic device and a light.

18. The method of claim 17, further comprising positioning two of the pair of adjacent parallel anchors adjacent each other to create two individual personal living spaces.

19. The method of claim 18, wherein the two of the pair of adjacent parallel anchors are aligned such that two of the anchors are along a line and the other two of the anchors are along another line offset from the line, and a wall is positioned between the pairs of adjacent parallel anchors to separate the two individual personal living spaces.

* * * * *